US005943739A

United States Patent [19]

Vandergriff

[11] Patent Number: 5,943,739

[45] Date of Patent: Aug. 31, 1999

[54] HINGE ASSEMBLY

[75] Inventor: David Houston Vandergriff, Powell, Tenn.

[73] Assignee: Lockheed Martin Energy Systems, Inc., Oak Ridge, Tenn.

[21] Appl. No.: 08/927,157

[22] Filed: Sep. 11, 1997

[51] Int. Cl.[6] ..... E05D 3/06; E05D 3/58

[52] U.S. Cl. ..... 16/366; 16/221

[58] Field of Search ..... 16/366, 368, 225, 16/250

[56] References Cited

U.S. PATENT DOCUMENTS

| | | | |
|---|---|---|---|
| 872,263 | 11/1907 | Torode | 16/366 |
| 1,009,108 | 11/1911 | Soss | 16/366 |
| 1,268,104 | 6/1918 | Flick et al. | 16/366 |
| 2,200,699 | 5/1940 | McNulty | 16/368 |
| 4,354,611 | 10/1982 | Propst et al. | 16/225 |
| 4,384,656 | 5/1983 | McQuiston et al. | 220/323 |
| 4,549,671 | 10/1985 | Fay, III | 16/366 |
| 4,834,434 | 5/1989 | Moore . | |
| 4,928,350 | 5/1990 | Morgan . | |
| 5,148,850 | 9/1992 | Urbanick . | |
| 5,493,760 | 2/1996 | Takimoto | 16/366 |
| 5,522,117 | 6/1996 | Connelly . | |

FOREIGN PATENT DOCUMENTS

| | | | |
|---|---|---|---|
| 0672844 | 12/1965 | Belgium | 16/366 |
| 2461799 | 3/1981 | France | 16/366 |
| 1158961 | 7/1969 | United Kingdom | 16/366 |

*Primary Examiner*—Michael F. Trettel
*Assistant Examiner*—Marcus Dolce
*Attorney, Agent, or Firm*—Hardaway Law Firm, P.A.

[57] ABSTRACT

A hinge assembly having a first leaf, a second leaf and linking member. The first leaf has a contact surface. The second leaf has a first contact surface and a second contact surface. The linking member pivotally connects to the first leaf and to the second leaf. The hinge assembly is capable of moving from a closed position to an open position. In the closed position, the contact surface of the first leaf merges with the first contact surface of the second leaf. In the open position, the contact surface of the first leaf merges with the second contact surface of the second leaf. The hinge assembly can include a seal on the contact surface of the first leaf.

18 Claims, 3 Drawing Sheets

HINGE ASSEMBLY

STATEMENT AS TO RIGHTS TO INVENTIONS MADE UNDER FEDERALLY-SPONSORED RESEARCH AND DEVELOPMENT

The U.S. Government has rights in this invention pursuant to contract number DE-AC05 84OR21400 between the United States Department of Energy and Lockheed Martin Energy Services, Inc.

BACKGROUND OF THE INVENTION

The present invention relates generally to a hinge assembly. Specifically, the present invention relates to a hinge assembly that is gapless and self-sealing at both an open position and a closed position.

A multitude of hinge assemblies exist to allow movement of two members relative to each other. U.S. Pat. No. 4,928,350 to Morgan discloses a hidden hinge. The hidden hinge utilizes two mounting plates, a U-shaped center link and a means for restraining the rotation of only one of the mounting plates. The hidden hinge allows only a narrow gap between the joined members.

U.S. Pat. No. 5,522,117 to Connelly discloses a moisture proof hinge. The moisture proof hinge uses two hinge parts and a metal pin connecting the hinge parts. One hinge part includes an integral flange of elastomeric material extending towards the second hinge part. The elastomeric material provides a moisture-proof seal throughout the limited range of motion of the hinge parts.

U.S. Pat. No. 5,148,850 to Urbanick discloses a weatherproof, continuous hinge for overhead doors. Adjacent door panels are connected with elongated, shock-absorbing, elastomeric members. The elastomeric members provide a weatherproof seal throughout the limited range of motion of the door panels in an overhead door assembly.

U.S. Pat. No. 4,834,434 to Moore discloses a permanent locking device for a nuclear waste container. A flat hinge on the lid supports a D-ring. The D-ring pivots and engages a malleable metal retaining strap on the box. A rubber gasket is positioned between the lid and the box. The rubber gasket is compressed between the lid and the box when the metal strap is bent down and over the D-ring.

Conventional hinge assemblies are lacking for several reasons. First, current moisture proof hinges are either limited in their range of motion, or merely prevent moisture ingress in one hinge position. Second, conventional hinges leave a gap between the members. Third, even hidden hinges only provide a gapless orientation at only one hinge position. Finally, continuous and hidden hinges require extra components to provide a seal at both an open position and a closed position.

Clearly, there is room for improvement in the art.

SUMMARY OF THE INVENTION

Therefore, it is an object of the present invention to provide a gapless hinge assembly.

It is a further object of the present invention to provide a hinge assembly without gaps in both an open position and a closed position.

It is a further object of the present invention to provide a self-sealing hinge assembly.

It is a further object of the present invention to provide a hinge assembly that is selfsealing in both an open position and a closed position.

It is a further object of the present invention to provide a gapless, self-sealing hinge assembly.

It is a further object of the present invention to provide a hinge assembly that is gapless and self-sealing at both an open position and a closed position.

These and other objects are achieved in one aspect of the present invention by a hinge assembly having a first leaf, a second leaf and linking member. The first leaf has a contact surface. The second leaf has a first contact surface and a second contact surface. The linking member pivotally connects to the first leaf and to the second leaf. The hinge assembly is capable of moving from a closed position to an open position. In the closed position, the contact surface of the first leaf merges with the first contact surface of the second leaf. In the open position, the contact surface of the first leaf merges with the second contact surface of the second leaf. The hinge assembly can include a seal on the contact surface of the first leaf.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

Figure 1:
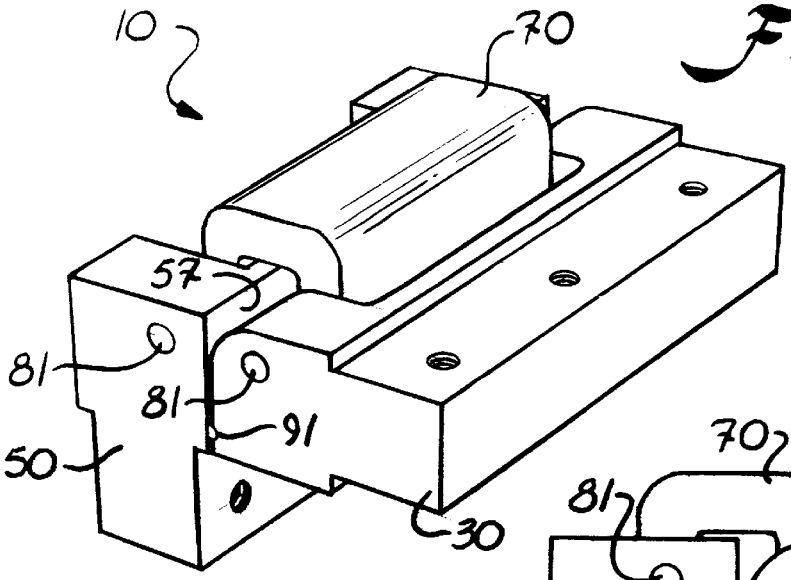
FIG. 1 is a perspective view of the hinge assembly of the present invention in an open position.

FIGS. 1–4 show several views of a hinge assembly 10. During use, hinge assembly 10 connects between two members (not shown) for relative movement between the members. Hinge assembly 10 includes a first leaf 30 and a second leaf 50. A linking member 70 interconnects first leaf 30 and second leaf 50. Hinge pins 81 allow pivotal movement between first leaf 30 and linking member 70; and second leaf 50 and linking member 70.

Figure 2:
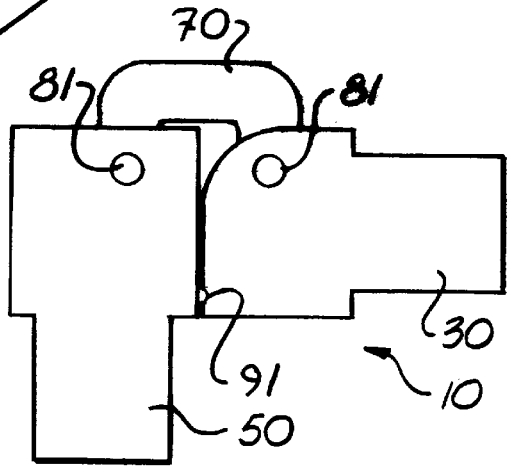
FIG. 2 is a perspective view of the hinge assembly of the present invention in a open position.
Figure 3:
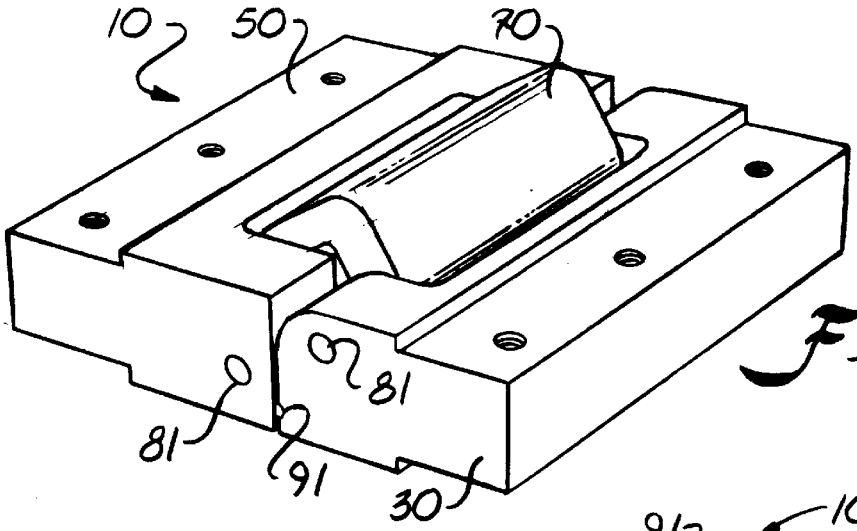
FIG. 3 is a side view of the hinge assembly of the present invention in an closed position.
Figure 4:
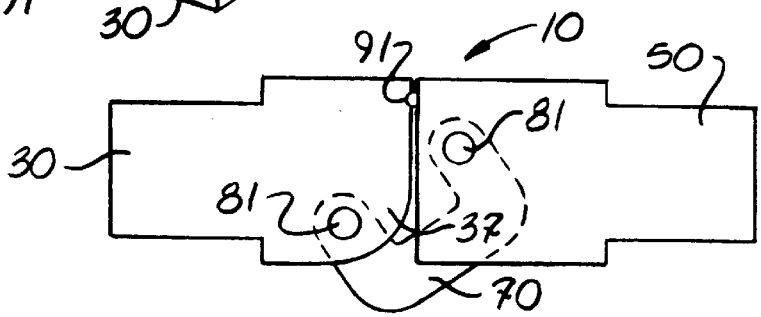
FIG. 4 is a side view of the hinge assembly of the present invention in a closed position.

Hinge assembly 10 can move between a closed and an open position. FIGS. 1 and 2 show hinge assembly 10 in an open condition. FIGS. 3 and 4 show hinge assembly 10 in a closed condition.

The present invention is suitable for use in a variety of environments. The present invention can be used, for example, in portable shelters, travel equipment, hazardous material handling, tailgates of vehicles, cabinets and aircraft panels. A detailed description of each element of hinge assembly 10 follows.

Figure 5:
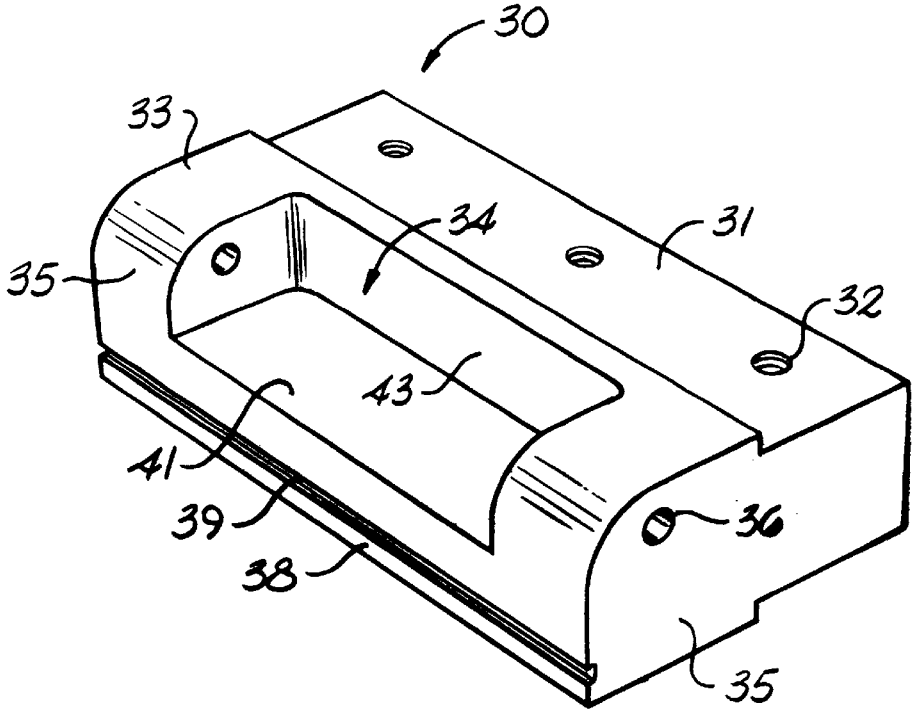
FIG. 5 is a perspective view of a first preferred embodiment of the first leaf of the hinge assembly of the present invention.
Figure 6:
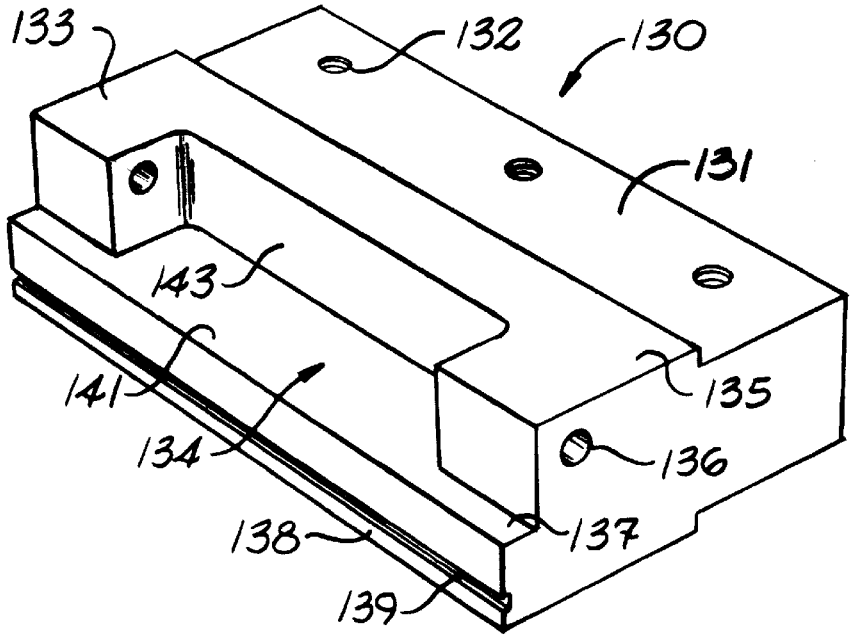
FIG. 6 is a perspective view of a second preferred embodiment of the first leaf of the hinge assembly of the present invention.

FIG. 5 is a perspective view of a first preferred embodiment of first leaf 30. FIG. 6 is a perspective view of a second preferred embodiment of a first leaf 130. Similar features of first leaves 30 and 130 use common numbers, except for a change in the hundred digit.

First leaf 30 includes an attachment portion 31 for securing to a first member (not shown). The first member can be, for example, a frame, a panel or a door. Attachment portion 31 can include a plurality of holes 32 for securing hinge assembly 10 to the first member. Holes 32 are preferably perpendicular to the longitudinal axis of first leaf 30. FIG. 5 shows attachment portion 31 having a rectangular shape and being smaller in thickness than the remainder of first leaf 30. Applicant recognizes, however, that attachment portion 31 can have any desired size or shape to assist in securing hinge assembly 10 to the first member. In addition, any other method of securing hinge assembly 10 to the first member, other than holes 32, can be used.

First leaf 30 also includes an interface portion 33. As described below, interface portion 33 interacts with linking member 70 and faces second leaf 50. Interface portion 33 includes a central portion having a channel 34 that accommodates a portion of linking member 70 as described below. Channel 34 has a bottom surface 41 and a rear surface 43. Opposite ends of interface portion 33 include brackets 35. The distance between brackets 35 is approximately the same as the width of linking member 70. Brackets 35 allow a portion of linking member 70 to sit within channel 34, but prevent linking member 70 from sliding within channel 34.

Brackets 35 each include a hole 36 for accommodating hinge pins 81 as described below. Holes 36 are preferably parallel to the longitudinal axis of first leaf 30. Holes 36 should preferably extend through brackets 35 at a distance above bottom surface 41 of channel 34 so as to allow rotation of an arm 72 of linking member 70 without interference. Linking member 70 is described in detail below.

Interface portion 33 includes a contact surface 38. Contact surface 38 extends between brackets 35 and along the central portion of interface portion 33. Contact surface 38 communicates with second leaf 50 when hinge assembly 10 is in both an open position (FIGS. 1 and 3) and a closed position (FIGS. 2 and 4). Contact surface 38 can directly contact, or merge with, second leaf 50 when hinge assembly 10 is in both an open position and a closed position. In this instance, contact surface 38 should be substantially planar in order to provide a uniform surface for sealing leaves 30,50.

However, in the preferred embodiment, contact surface 38 includes a groove 39 housing a seal 91. Seal 91 directly contacts second leaf 50 when hinge assembly 10 is in both an open position and a closed position. Seal 91 is self-sealing. Mere movement of the hinge leaves secures seal 91 against second leaf 50 when in an open position and in a closed position. No additional components are necessary. Seal 91 can be manufactured from any suitable elastomeric material.

Brackets 35 of first leaf 30 include a recessed area. The recessed area allows unobstructed movement between first leaf 30 and second leaf 50. As shown in FIGS. 3–5, the recessed area can be a rounded corner 37.

First leaf 130 is substantially identical to first leaf 30. Accordingly, only a brief discussion follows. First leaf 130 includes an attachment portion 131. Attachment portion 131 can include a plurality of holes 132. Holes 132 are preferably perpendicular to the longitudinal axis of first leaf 30.

First leaf 130 also includes an interface portion 133. Interface portion 133 includes a central portion having a channel 134 that accommodates a portion of linking member 70 as described below. Channel 134 has a bottom surface 141 and a rear surface 143. Opposite ends of interface portion 133 include brackets 135. The distance between brackets 135 is approximately the same as the width of linking member 70. Brackets 135 allow a portion of linking member 70 to sit within channel 134, but prevent linking member 70 from sliding within channel 134.

Brackets 135 each include a hole 136 for accommodating hinge pins 81 as described below. Holes 136 are preferably parallel to the longitudinal axis of first leaf 30. Holes 136 should preferably extend through brackets 135 at a distance above a bottom 141 of channel 134 so as to allow rotation of arm 72 of linking member 70 without interference.

Interface portion 133 includes a contact surface 138 extending between brackets 135 and along the central portion. Contact surface 138 communicates with second leaf 50 when hinge assembly 10 is in both an open position and a closed position. Contact surface 138 can directly contact, or merge with, second leaf 50 when hinge assembly 10 is in both an open position and a closed position. In this instance, contact surface 138 should be substantially planar in order to provide a uniform surface for sealing leaves 130,50.

However, in the preferred embodiment, contact surface 138 includes a groove 139 housing a seal 91. Seal 91 directly contacts second leaf 50 when hinge assembly 10 is in both an open position and a closed position. Seal 91 is self-sealing. Mere movement of the hinge leaves secures seal 91 against second leaf 50 when in an open position and in a closed position. No additional components are necessary. Seal 91 can be manufactured from any suitable elastomeric material.

First leaf 130 has a different recessed area than first leaf 30. The recessed area of bracket 135 allows unobstructed movement between first leaf 130 and second leaf 50. As shown in FIG. 6, the recessed area can be a notch 137. The recessed area of bracket 135 can have any desired shape to allow unobstructed movement between first leaf 130 and second leaf 50.

Figure 7:
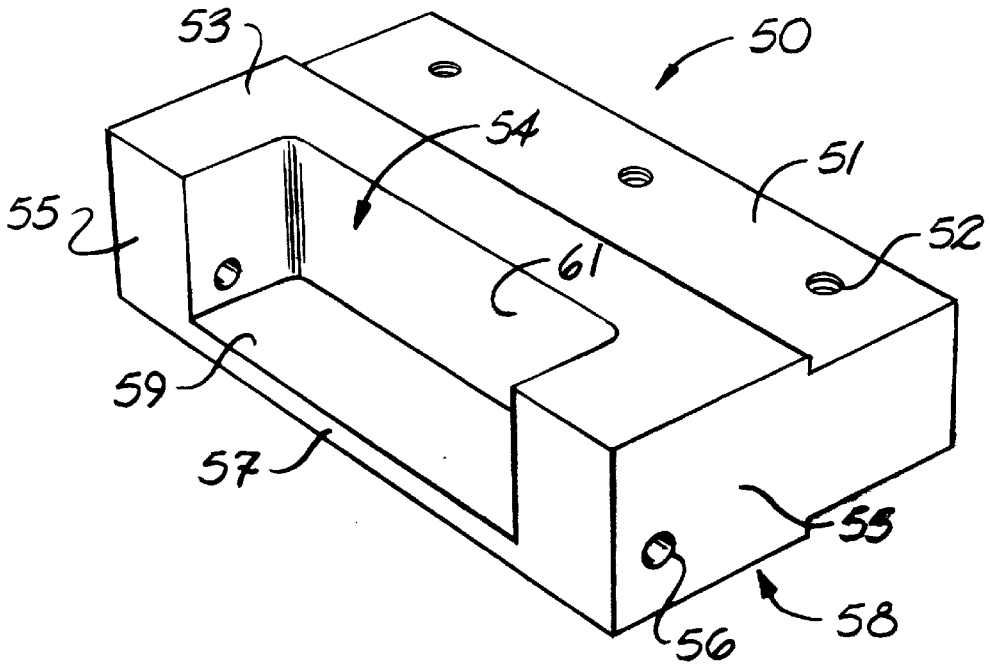
FIG. 7 is a perspective view of the second leaf of the hinge assembly of the present invention.

FIG. 7 is a perspective view of second leaf 50 of hinge assembly 10. Second leaf 50 includes an attachment portion 51 for securing to a second member (not shown). The second member can be, for example, a frame, a panel or a door. Attachment portion 51 can include a plurality of holes 52 for securing hinge assembly 10 to the second member. Holes 52 are preferably perpendicular to the longitudinal axis of second leaf 50. FIG. 7 shows attachment portion 51 having a rectangular shape and being smaller in thickness than the remainder of second leaf 50. Applicant recognizes, however, that attachment portion 51 can have any desired size or shape to assist in securing hinge assembly 10 to the second member. In addition, any other method of securing hinge assembly 10 to the second member, other than holes 52, can be used.

Second leaf 50 also includes an interface portion 53. Interface portion 53 interacts with linking member 70 and faces interface portion 33 of first leaf 30. Interface portion 53 includes a central portion having a channel 54 that accommodates a portion of linking member 70 as described below. Channel 54 has a bottom surface 59 and a rear surface 61. Channel 54 is larger than channel 34 of first leaf 30. In the closed position shown in FIGS. 2 and 4, channel 54 can accommodate a larger portion of linking member 70 than channel 34 of first leaf 30.

Opposite ends of interface portion 53 include brackets 55. The distance between brackets 55 is approximately the same as the width of linking member 70. Brackets 55 allow a portion of linking member 70 to sit within channel 54, but prevent linking member 70 from sliding within channel 54.

Brackets 55 each include a hole 56 for accommodating hinge pins 81 as described below. Holes 56 are preferably parallel to the longitudinal axis of second leaf 50. Holes 56 should preferably extend through brackets 55 at a distance above bottom 59 of channel 54 so as to allow rotation of arm 72 of linking member 70 without interference.

Since channel 54 is larger than channel 34 of first leaf 30, holes 56 are not aligned with holes 36 of first leaf 30 when in the closed position. As a result, linking member 70 does not lie in the same longitudinal plane as first leaf 30 or second leaf 50. FIGS. 2 and 4 show that holes 56 are parallel, but not aligned in their longitudinal planes. FIGS. 2 and 4 also show that linking member is angled relative to first leaf 30 and second leaf 50 in the closed position.

Interface portion 53 includes a first contact surface 57 and a second contact surface 58. First contact surface 57 extends between brackets 55 and along the central portion of interface portion 53. First contact surface 57 communicates with first leaf 30 when hinge assembly 10 is in a closed position (FIGS. 2 and 4). First contact surface 57 can directly contact, or merge with, first leaf 50 when hinge assembly 10 is in a closed position. In this instance, contact surface 57 should be planar in order to provide a uniform surface for sealing leaves 30,50 in the closed position. However, in the preferred embodiment, first contact surface 57 directly contacts seal 91 on first leaf 30.

Second contact surface 58 is located on an adjacent side of second leaf 50. Second contact surface 58 communicates with first leaf 30 when hinge assembly 10 is in an open position (FIGS. 1 and 3). Second contact surface 58 can directly contact, or merge with, first leaf 50 when hinge assembly 10 is in an open position. In this instance, contact surface 58 should be planar in order to provide a uniform surface for sealing leaves 30,50 in the open position. However, in the preferred embodiment, second contact surface 58 directly contacts seal 91 on first leaf 30.

Figure 8:
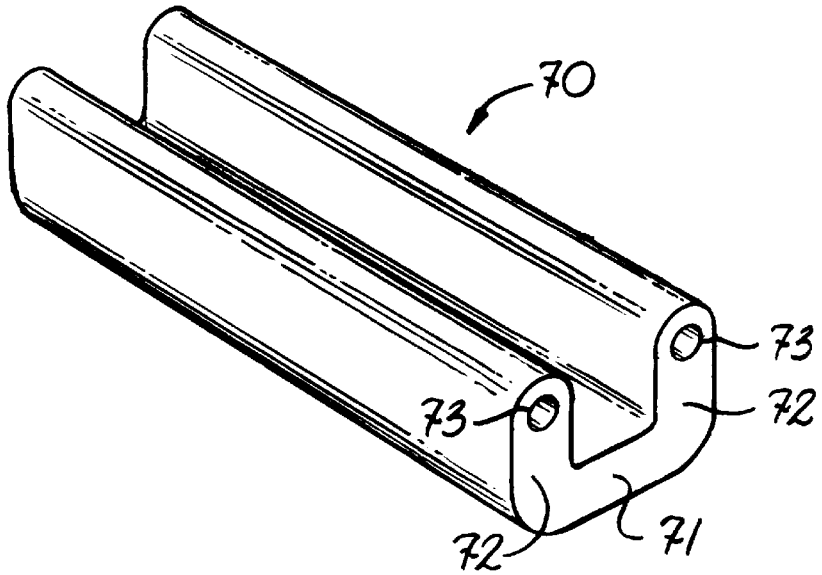
FIG. 8 is a perspective view of the linking member of the hinge assembly of the present invention.

FIG. 8 is a perspective view of linking member 70 of hinge assembly 10 of the present invention. Linking member 70 is preferably U-shaped. Linking member 70 includes a base portion 71 and two substantially parallel arms 72 extending therefrom. The distal end of each arm 72 include a hole 73. Holes 73 are preferably parallel to the longitudinal axis of linking member 70.

The assembly of hinge assembly 10 will now be described. One arm 72 of linking member 70 is inserted into channel 34 of first leaf 30. Hole 73 of linking member 70 is aligned with holes 36 of first leaf 30. A hinge pin 81 is inserted through the aligned holes. Hinge pin 81 could be a unitary pin. Alternatively, two hinge pins 81 could be used to secure each bracket 35 to linking member 70.

Pivotal movement of arm 72 relative to first leaf 30 is limited by the contact between arm 72 and rear surface 43 of channel 34. The limit of pivotal movement is greater than the movement required to open and close hinge assembly 10. In other words, the range of movement between leaves 30,50 is more than is required to open and close hinge assembly 10.

The other arm 72 of linking member 70 is inserted into channel 54 of second leaf 50. Hole 73 of linking member 70 is aligned with holes 56 of second leaf 50. A hinge pin 81 is inserted through the aligned holes. Hinge pin 81 could be a unitary pin. Alternatively, two hinge pins 81 could be used to secure each bracket 35 to linking member 70.

Pivotal movement of arm 72 relative to second leaf 50 is limited by the contact between arm 72 and rear surface 61 of channel 54. The limit of pivotal movement is greater than the movement required to open and close hinge assembly 10. In other words, the range of movement between leaves 30,50 is more than is required to open and close hinge assembly 10.

Hinge assembly 10 is now assembled. FIGS. 2 and 4 show hinge assembly 10 in a closed position. Linking member 70 is angled relative to first leaf 30 and second leaf 50. Also, contact surface 38 of first leaf 30 faces first contact surface 57 of second leaf 50. Seal 91 directly contacts, or merges with, first contact surface 57 of second leaf 50. Seal 91 prevents contaminants from passing between first leaf 30 and second leaf 50 in the closed position.

Alternatively, contact surface 38 of first leaf 30 can be manufactured without groove 39 (not shown). In this embodiment, contact surface 38 directly contacts, or merges with, first contact surface 57 of second leaf 50.

Hinge assembly 10 connects two members (not shown) for relative movement therebetween. First leaf 30 preferably is secured to a non-moving member, whereas second leaf 50 is secured to the moving member. Hinge assembly 10 can either be secured to the members with linking member 70 facing an interior (i.e. an internal hinge), or facing an exterior (i.e. an external hinge). Second leaf 50 pivots relative to first leaf 30. In the closed position shown in FIGS. 3 and 4, the longitudinal planes of first leaf 30 and second leaf 50 are parallel, preferably co-planar. The embodiment described herein allows for approximately 90° rotation of second leaf 50 relative to first leaf 30.

FIGS. 1 and 2 demonstrate hinge assembly 10 in an open position. In the open position, the longitudinal planes of first leaf 30 and second leaf 50 are approximately perpendicular. Holes 36 of first leaf 30 and holes 56 of second leaf 50 form a plane that is parallel to the longitudinal axis of first leaf 30. As a result, equal portions of linking member 70 extend into channel 34 of first leaf 30 and channel 54 of second leaf 50. Also, contact surface 38 of first leaf 30 faces second contact surface 58 of second leaf 50. Seal 91 of first leaf 30 directly contacts, or merges with, second contact surface 58 of second leaf 50. Seal 91 prevents contaminants from passing between first leaf 30 and second leaf 50 in the closed position.

As discussed previously, contact surface 38 of first leaf 30 can be manufactured without groove 39 (not shown). In this embodiment, contact surface 38 directly contacts, or merges with, second contact surface 58 of second leaf 50.

Although described herein with reference to a hinge assembly allowing approximately 90° rotation between hinge leaves, Applicant recognizes that the hinge assembly of the present invention is capable of allow for rotations other than 90° rotation. For example, the present invention can be used in hinge assemblies allowing 180° rotation, 270° rotation, or allowing variable rotation.

It is also understood that many other variations are apparent to one of ordinary skill in the art from a reading of the above specification. Such variations are within the spirit and scope of the instant invention as defined by the following appended claims.

I claim:

1. A hinge assembly comprising:

a first leaf having a contact surface;

a second leaf having a first contact surface and a second contact surface; and a linking member pivotally connected at opposite ends to said first leaf and to said second leaf for moving said second leaf relative to said first leaf between a closed position and an open position;

a seal;

wherein said contact surface of said first leaf includes a groove accommodating said seal so that said seal abuts said first contact surface of said second leaf in said closed position; and said seal abuts said second contact surface of said second leaf in said open position; and wherein, at said closed position, said contact surface of said first leaf abuts said first contact surface of said second leaf; and, at said open position, said contact surface of said first leaf abuts said second contact surface of said second leaf.

2. The hinge assembly as recited in claim 1, wherein said linking member is U-shaped.

3. The hinge assembly as recited in claim 1, further comprising a plurality of hinge pins pivotally connecting said linking member to said first leaf and said second leaf.

4. The hinge assembly as recited in claim 1, wherein an angle between said closed position and said open position is approximately 90°.

5. The hinge assembly as recited in claim 1, wherein said first leaf includes a recessed area.

6. The hinge assembly as recited in claim 5, wherein said recessed area comprises a rounded corner.

7. The hinge assembly as recited in claim 5, wherein said recessed area comprises a notch.

8. The hinge assembly as recited in claim 1, wherein said contact surface of said first leaf and said first and second contact surfaces of said second leaf are substantially planar.

9. A hinge assembly for connecting a first member to a second member, comprising:

a first leaf, said first leaf comprising:

an attachment portion for securing said first leaf to a first member;

said first leaf further comprising an interface portion including a pair of brackets each having a hole therethrough, a channel disposed between said brackets, and a contact surface;

a second leaf, said second leaf comprising:

an attachment portion for securing said second leaf to a second member;

said second leaf further comprising an interface portion including a pair of brackets each having a hole therethrough, a channel disposed between said brackets, a first contact surface and a second contact surface;

a U-shaped linking member having a base; and a pair of arms, each having a hole therethrough; said linking member partially disposed within said channel of said first leaf and said channel of said second leaf;

a pair of hinge pins each inserted in the respective said holes of said pair of brackets of said first leaf and said second leaf and in said holes of said linking member for pivotally connecting each of said arms of said linking member to said pair of brackets on said first leaf and said second leaf between a closed position and an open position; and a seal;

wherein said contact surface of said first leaf includes a groove accommodating said seal so that said seal abuts said first contact surface of said second leaf in said closed position; wherein said seal abuts said second contact surface of said second leaf in said open position; and wherein, at said closed position, said contact surface of said first leaf abuts said first contact surface of said second leaf; and, at said open position, said contact surface of said first leaf abuts said second contact surface of said second leaf.

10. The hinge assembly for connecting a first member to a second member as recited in claim 9, wherein an angle between said closed position and said open position is approximately 90°.

11. The hinge assembly for connecting a first member to a second member as recited in claim 9, wherein said pair of brackets of said first leaf each includes a recessed area.

12. The hinge assembly for connecting a first member to a second member as recited in claim 11, wherein said recessed area comprises a rounded corner.

13. The hinge assembly for connecting a first member to a second member as recited in claim 11, wherein said recessed area comprises a notch.

14. The hinge assembly for connecting a first member to a second member as recited in claim 9, wherein said channel of said second leaf is deeper than said channel of said first leaf.

15. The hinge assembly for connecting a first member to a second member as recited in claim 14, wherein said channel of said first leaf includes a bottom surface; said channel of said second leaf includes a bottom surface; said holes of said pair of brackets of said first leaf are positioned a distance from said bottom surface of said channel of said first leaf; and said holes of said pair of brackets of said second leaf are positioned a distance from said bottom surface of said channel of said second leaf approximately equal to the distance between said holes of said pair of brackets of said first leaf and said bottom surface of said channel of said first leaf.

16. The hinge assembly for connecting a first member to a second member as recited in claim 9, wherein said interface portion of said first leaf has a thickness; and said attaching portion of said first leaf has a thickness less than said thickness of said interface portion of said first leaf.

17. The hinge assembly for connecting a first member to a second member as recited in claim 9, wherein said interface portion of said second leaf has a thickness; and said attaching portion of said second leaf has a thickness less than said thickness of said interface portion of said second leaf.

18. The hinge assembly for connecting a first member to a second member as recited in claim 9, wherein said contact surface of said first leaf and said first and second contact surfaces of said second leaf are substantially planar.

* * * * *